United States Patent [19]

Facklam

[11] Patent Number: 4,482,259

[45] Date of Patent: Nov. 13, 1984

[54] LASER CLOCK

[75] Inventor: Roger L. Facklam, Dayton, Ohio

[73] Assignee: The United States of America as represented by the Secretary of the Air Force, Washington, D.C.

[21] Appl. No.: 498,238

[22] Filed: May 26, 1983

[51] Int. Cl.[3] ..... G04F 8/00; G04F 5/00

[52] U.S. Cl. ..... 368/118; 368/156; 372/32

[58] Field of Search ..... 368/10, 118–121, 368/155, 156; 356/350; 372/32

[56] References Cited

U.S. PATENT DOCUMENTS

| | | | |
|---|---|---|---|
| 3,462,708 | 8/1969 | McClure | 331/94.5 |
| 3,597,088 | 8/1971 | Catherin | 356/106 |
| 3,627,425 | 12/1971 | Doyle | 356/350 |
| 3,786,681 | 1/1974 | Kiehn | 73/382 |
| 3,851,973 | 12/1974 | Macek | 356/106 LR |
| 3,867,034 | 2/1975 | Aronowitz | 356/350 |
| 4,006,989 | 2/1977 | Andringa | 356/350 |
| 4,110,045 | 8/1978 | Smith, Jr. et al. | 356/106 LR |
| 4,121,178 | 10/1978 | Schlossberg | 331/94.5 G |
| 4,277,173 | 7/1981 | Ljung et al. | 356/350 |

OTHER PUBLICATIONS

Smith et al., "Biasing the Raytheon Four-Frequency Ring Laser Gyroscope", SPIE, vol. 157 (1978), pp. 21–29.

Facklam, "Ultra-Stable Laser Clock", Abstract of Oral Presentation Given at Minisymposium of AIAA held at Air Force Institute of Technology, Wright-Patterson AFB, Ohio, on Mar. 23, 1982. The Abstract was Distributed to Attendees on Mar. 23, 1982.

*Primary Examiner*—Vit W. Miska

*Attorney, Agent, or Firm*—Donald J. Singer; John R. Flanagan

[57] ABSTRACT

A laser clock includes a linear laser in one embodiment of the clock and a ring laser gyro in the other embodiment. The linear laser is frequency stabilized and utilizes a single active medium in the form of a low pressure gas, such as He-Ne, with a Doppler broadened gain curve. The ring laser gyro is a four frequency laser with a Faraday rotor. Detector and electronic circuitry associated with the laser of each embodiment detect a beat frequency and converts it to a clock signal.

5 Claims, 5 Drawing Figures

LASER CLOCK

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

The present invention broadly relates to high accuracy timing sources and, more particularly, is concerned with a laser clock for providing a stable, highly accurate source of timing that will not degrade under acceleration and have low unit cost.

2. Description of the Prior Art

A current Air Force problem is to provide high accuracy timing for fighter aircraft. The clock must operate between −50° C. and +95° C. The clock must also operate under a 6 g load during an aircraft maneuver and up to a 10 g maximum load for vibration.

Currently, the clock is heated to above +75° C. so that it can use the environment as a heat sink. To achieve this temperature, the clock must first be warmed up and then allowed to stabilize. However, the process of thermal stabilization needs to be reduced or eliminated because, in emergency situations, aircraft cannot set on the runway while waiting for the clock to stabilize. Another consideration is the cost of the clock. The cost of an aircraft grade Cesium atomic clock, currently used, is about $40,000.

Consequently, a need exists for an improved timing source adapted for use in modern Air Force fighter aircraft which does not degrade under high accelerations, requires little or no time for stabilization, and has a lower unit cost.

SUMMARY OF THE INVENTION

The present invention provides a high accuracy laser clock designed to satisfy the aforementioned needs. Although a linear laser may be used in the clock, in a preferred embodiment the clock makes use of a ring laser gyro which is also to be used in future military aircraft for rotation rate sensing. The advantages of the laser approach are small size, fast warm-up, low sensitivity to g loads, and reduced cost. The laser provides the timing frequency for the laser clock. The only additional requirements are the detection and output electronics.

Accordingly, the present invention is directed to a laser clock wherein one embodiment the laser is a linear laser, while in the other embodiment it is a multi-frequency ring laser gyro. The linear laser is frequency-stabilized and utilizes a single active medium in the form of a low pressure gas, such as He-Ne, with a Doppler broadened gain curve. The linear laser generates a pair of output beams that are orthogonally polarized. A polarizer combines the two polarizations and forms a modified beam containing a beat frequency. Electronic circuitry then detects the beat frequency of the modified beam and converts it to a clock signal.

The ring laser gyro generates two right hand circularly polarized modes and two left hand circularly polarized modes with one traveling clockwise (CW) around the ring and the other counter-clockwise (CCW). Then, the beat frequency of the CW beams is detected by electronic circuitry separately from the beat frequency of the CCW beams. The separate beat frequencies are amplified, filtered and then summed. Finally, the sum of the beat frequencies is converted by the circuitry means to a clock signal.

DETAILED DESCRIPTION OF THE INVENTION

Figure 1:
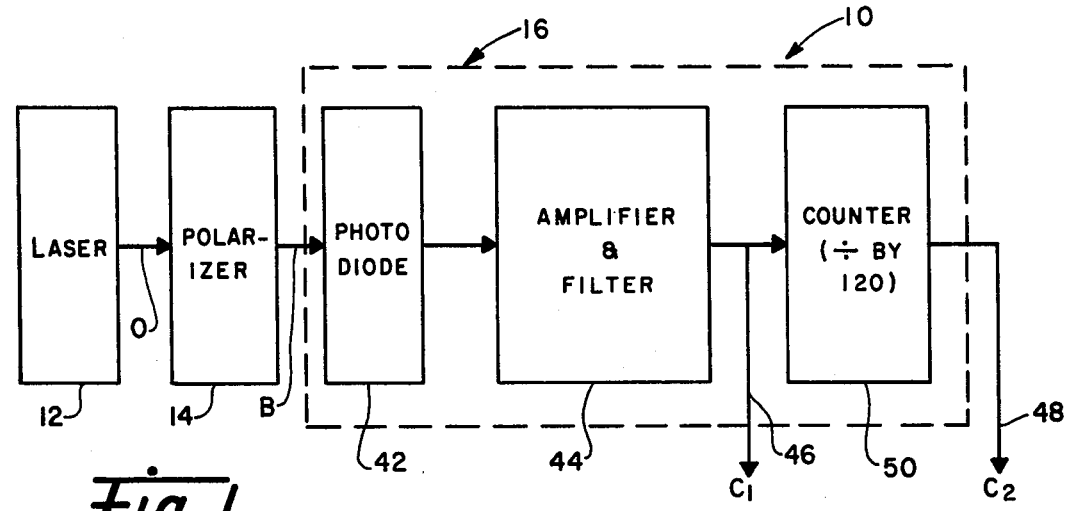
FIG. 1 is a schematic of one embodiment of the laser clock of the present invention.

Referring now to the drawings, and more particularly to FIG. 1, there is shown one embodiment of the laser clock of the present invention, being generally designated 10. The laser clock 10 includes a frequency-stabilized linear laser 12 which generates a pair of output beams that are orthogonally polarized, means 14 for receiving the output beams so as to combine the two polarizations and form a modified beam containing a beat frequency, and means 16 for detecting the modified beam and converting the beat frequency therein to a clock signal.

Figure 2:
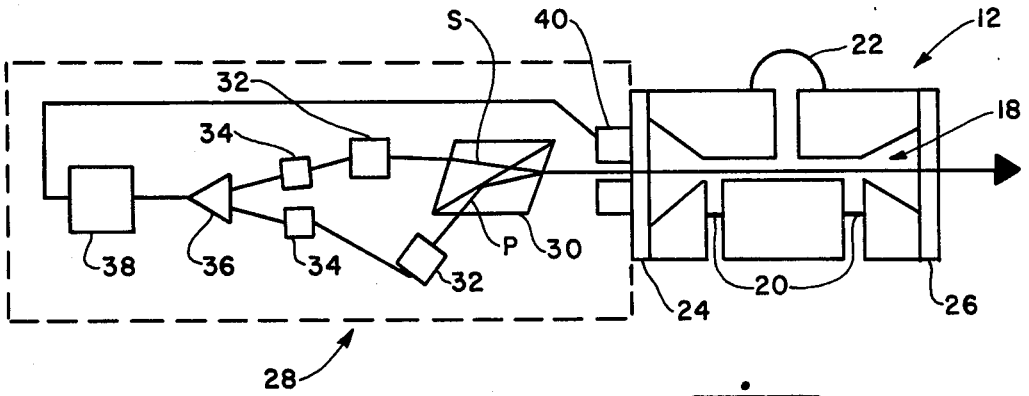
FIG. 2 is a schematic view of a linear laser used in the embodiment of the laser clock of FIG. 1.
Figure 3:
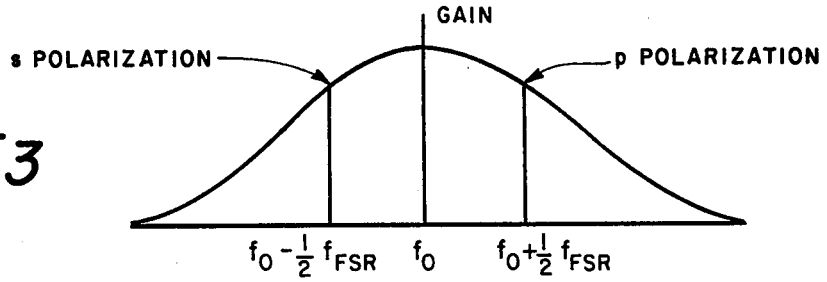
FIG. 3 is a single gain curve containing the s and p polarized frequency modes of the output of the linear laser of FIG. 1.

The linear laser 12, as seen in FIG. 2, is preferably a He-Ne laser with a CER-VET cavity 18. The laser 12 further includes anodes 20 and cathode 22 on opposite sides of the cavity 18, and an adjustable mirror 24 and an output mirror 26 disposed at opposite ends of the cavity 18. For high stability frequency control a two-longitudinal mode linear inhomogeneously (or Doppler) broadened laser, such as the He-Ne laser, is used which includes a feedback control system 28. Frequency stability can be obtained by balancing the intensity of the outpout frequency modes of the laser 12. The output O is made up of two beams S and P, one being a first frequency mode with s polarization and the other being a second frequency mode with p polarization. FIG. 3 shows a single gain curve which is a composite of two overlapping gain curves (one due to $^{20}$Ne and the other $^{22}$Ne) and shows the output O of the laser 12 with balanced mode intensities between s and p polarizations.

In the feedback control system 28, as seen in FIG. 2, the output O transmitted by adjustable mirror 24 is separated by the Nicol prism 30 into the two different beams S and P. The separate beams are received by detectors 32, amplified by amplifiers 34 and a difference signal is outputted by differential amplifier 36 to a PZT circuit 38. The circuit 38 drives the piezo-electric transducer 40 to continuously adjust the position of the mirror 24, and thereby change the lengtrh of catity 18, and continuously set the difference signal toward zero.

For converting the output O of laser 12 to a clock signal, the output O is also transmitted by output mirror 26 to receiving means 14 in the form of a polarizer which transforms portions of the two beams S and P into a modified beam B which contains the beat frequency mode of the two beams when combined together.

From the polarizer 14, the modified beam B containing the beat frequency mode is detected by means 16 and converted to a clock signal. Means 16 includes a photodiode 42 for detecting the modified beam and converting it to a voltage signal. Then amplifier-and-filter 44 receives the voltage signal. Means 44 increases the signal level and reduces the off center frequency noise before passing it as a clock signal $C_1$ on output 46 in the form of a sine wave at the beat frequency. Another clock signl $C_2$ on output 48 has been divided down by a factor of 120 relative to the frequency of the clock signal $C_1$ by a counter 50.

The clock laser 10 of FIG. 1 allows easy conversion of a visible frequency to a megahertz frequency. For example, a He-Ne laser with $\lambda=6328$Å, $f_o=4.737\times10^{14}$ Hz and L (length of laser) $=0.149896229$ m, $$f_{beat} = (f_o + \tfrac{1}{2}f_{FSR}) - (f_o - \tfrac{1}{2}f_{FSR}) = f_{FSR} \qquad \text{Eq. (1)(a)}$$

$$f_{FSR} = \frac{C}{2L} = \frac{2.99792458 \times 10^8 \text{m/sec}}{(2)(.149896229\text{m})} = 1\text{GHz} \qquad \text{Eq. (1)(b)}$$

The quantum uncertainty is as follows:

$$\Delta f = \frac{f_o}{Q}\sqrt{\frac{hfB}{P}} \qquad \text{Eq. (2)(a)}$$

$$\text{Therefore, } \Delta f = 1 \times 10^{-3}\text{Hz} \qquad \text{Eq. (2)(b)}$$

for: $f_o = 4.737 \times 10^{14}$Hz
$Q = 4.6 \times 10^8$
$B = \frac{1}{2}T$, for $T = 1.66$ sec, $B = .3012$ sec$^{-1}$
$P_{int} = 100$ mw
$n = 6.626 \times 10^{-34}$ $J$ − sec $$\text{This gives: } \frac{\Delta f}{f} = 1 \times 10^{-12}, \qquad \text{Eq. (3)}$$

which is a measure of the frequency stability.

Figure 4:
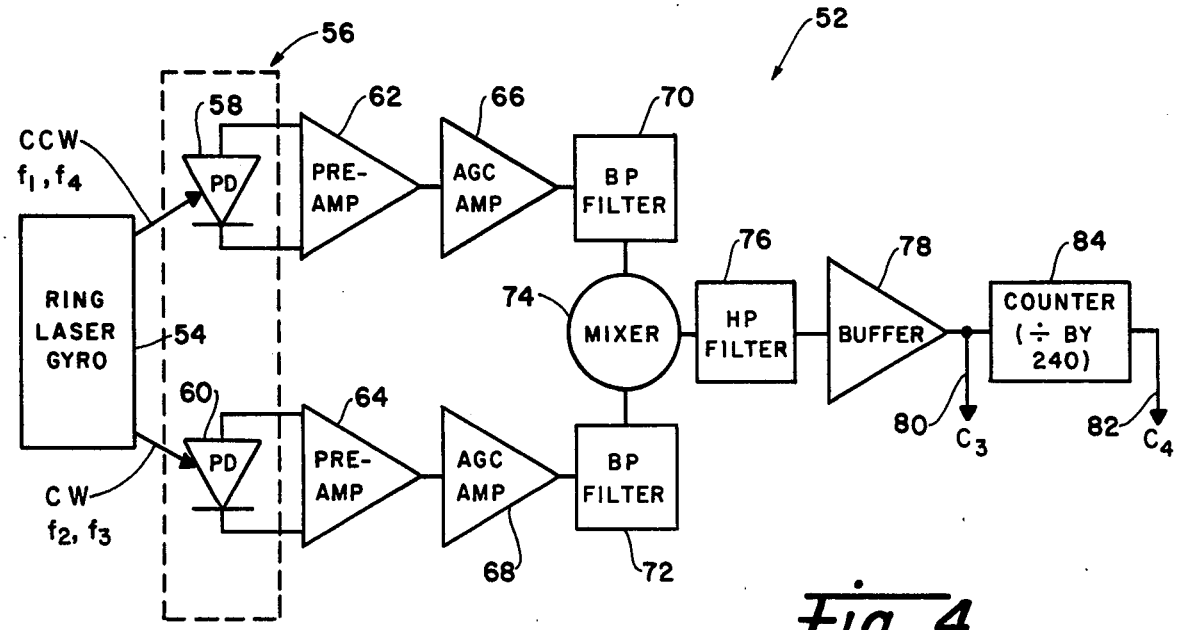
FIG. 4 is a schematic view of a ring laser gyro and its associated electronic circuitry which forms the other embodiment of the laser clock of the present invention.
Figure 5:
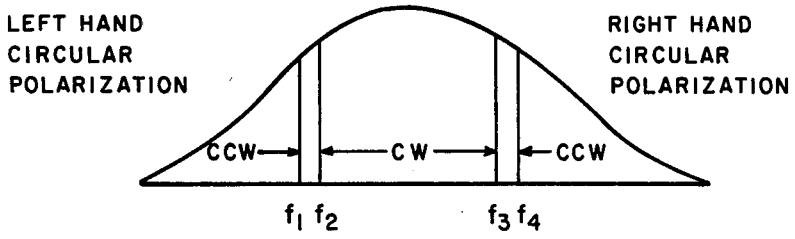
FIG. 5 is another single gain curve containing the four frequency modes of the output of the ring laser in the clock of FIG. 4.

The preferred embodiment of the laser clock is shown in FIG. 4 and is generally designated 52. The laser clock 52 includes a four frequency operating ring laser gyro 54 with a Faraday rotor (not shown), such as described in U.S. Pat. No. 4,110,045 of I. W. Smith, Jr. and T. A. Dorschner, the disclosure of which is incorporated by reference herein. The ring laser gyro 54 serves a dual function: it provides both a clock frequency for timing and information for navigation. A simple ring laser gyro generates a pair of output geams based on the fact that there is a difference in path lengths of the clockwise (CW) and counterclockwise (CCW) beams when the device rotates. Each output beam contains a pair of frequency modes. When the ring laser gyro incorporates a Faraday rotor, as described in the above-cited patent, a first pair of frequency modes $f_1$, $f_4$ of one output beam CCW both travel counterclockwise in the laser gyro 54 nd are right and left hand circularly polarized, respectively, and a second pair of frequency modes $f_2$, $f_3$ of the other output beam CW both travel clockwise in the laser gyro 54 and are right and left hand circularly polarized respectively. FIG. 5 shows a single gain curve which is composite of two overlapping gain curves (one due to $^{20}$Ne and the other $^{22}$Ne) and shows the output of the four frequency ring laser gyro 54 with the Faraday rotor. Each of the four modes has a different optical path length because the Faraday rotor (not shown) is a non-reciprocal optical device.

The laser clock 52 also includes means 56 for detecting the beat frequency of the CW beams $(f_3-f_2)$ separately from the beat frequency of the other CCW beams $(f_4-f_1)$. Each of the respective beat frequencies are converted to a corresponding voltage by the photodiodes 58, 60 and then are received and amplified to an appropriate level by respective pairs of tandemly connected pre-amplifiers 62, 64 and AGC amplifiers 66, 68. Following filtering by separate bandpass filters 70, 72, the outputs of the two amplifiers are received by a mixer 74. The mixer 74 sums the two beat frequencies to form a sum beat frequency, $f_5$, which is equal to $(f_4-f_1)+(f_3-f_2)$. After the sum beat frequency is filtered by a high pass filter 76 and further amplified by buffer 78, clock signal $C_3$ is available on output 80 in the form of a sine wave at the sum beat frequency $f_5$. Another clock signal $C_4$ on output 82 has been divided down by a factor of 240 relative to the frequency of the clock signal $C_3$ by a counter 84.

In summary, the Faraday-compensated clock frequency is given by $$f_{clock}=(f_4-f_1)+(f_3-f_2).$$

Faraday-induced frequency shifts, due to temperature variation effects, are compensated for by the addition of the two beat frequencies. When the Faraday effect increases, $(f_4-f_1)$ is increased by the same amount that $(f_3-f_2)$ decreases, thus holding a constant sum. This should allow the clock to remain at the quantum limit for longer time periods. The quantum limited frequency uncertainty $\Delta f_Q(\tau)$ is given by $$\Delta f_Q(\tau) = \frac{f_o}{Q}\sqrt{\frac{hf_o}{2P\tau}}$$

where $$Q = \frac{f_o E}{2\pi P} \text{ and}$$

$f_o$ is the laser frequency, h is Planch's constant, Q is a measure of the resonators ability to store energy, P is the circulating power, $\tau$ is the measuring time, and E is the stored energy. The quantum limit for the clock (QLC) is the ratio of the quantum limited frequency uncertainty to the clock frequency and is given by $$QLC(\tau) = \frac{\Delta f_Q(\tau)}{f_{clock}}$$

It is thought that the laser clock of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof. cm Having thus described the invention, what is claimed is:

1. A laser clock comprising:

(a) a frequency-stabilized linear laser utilizing an active medium in the form of a low pressure gas with a single Doppler broadened gain curve for generating a pair of output beams that are orthogonally polarized;

(b) means receiving said output beams so as to combine said polarizations and form a modified beam containing a beat frequency; and (c) means for detecting said modified beam having said beat frequency and converting the same to a clock signal.

2. The laser clock as recited in claim 1, wherein:

said linear laser is a He-Ne laser;

said receiving means is a polarizer; and said detecting and converting means includes (i) a photodiode for detecting said modified beam and converting it to a voltage signal, (ii) amplifying and filtering means for receiving said voltage signal and increasing the signal level while reducing side band power, and (iii) counter means for receiving said signal and generating a clock signal proportional to said beat frequency of said modified output beam.

3. A laser clock, comprising:

(a) a four frequency ring laser gyro with a Faraday rotor for generating a pair of output beams, each containing two frequency modes;

(b) means for detecting a first beat frequency of one beam separately from a second beat frequency of the other beam, said first beat frequency being the difference between said frequency modes of said one beam, and said second beat frequency being the difference between said frequency modes of said other beam;

(c) means for receiving said respective beat frequencies separately and amplifying and filtering the same;

(d) means for receiving said amplified and filtered beat frequencies and summing said beat frequencies; and (e) means for receiving said summed beat frequencies and converting the same to a clock signal.

4. The laser clock as recited in claim 3, wherein:

said frequency modes of said one output beam both travel clockwise in said laser and are right and left hand circularly polarized, respectively; and said frequency modes of said other output beam both travel counter-clockwise in said laser and are right and left hand circularly polarized, respectively.

5. The laser clock as recited in claim 3, wherein said detecting means is a pair of photodiodes for separately detecting said first and second beat frequencies.

* * * * *

UNITED STATES PATENT AND TRADEMARK OFFICE

CERTIFICATE OF CORRECTION

PATENT NO. : 4,482,259

DATED : November 13, 1984

INVENTOR(S) : Roger L. Facklam

It is certified that error appears in the above-identified patent and that said Letters Patent is hereby corrected as shown below:

In the ABSTRACT, last line, "converts" should be ---convert---.

Column 2, line 45, "outpout" should be ---output---.

Column 2, line 62, "lengtrh" should be ---length---.

Column 3, line 35, "$B = \frac{1}{2}T$" should be ---$B=\frac{1}{2T}$---.

Column 3, line 59, "nd" should be ---and---.

Signed and Sealed this

Seventh Day of May 1985

[SEAL]

*Attest:*

DONALD J. QUIGG

*Attesting Officer* *Acting Commissioner of Patents and Trademarks*